United States Patent [19]

Malak

[11] 4,086,494

[45] Apr. 25, 1978

[54] RADIATION COLLIMATOR FOR USE WITH HIGH ENERGY RADIATION BEAMS

[76] Inventor: Stephen P. Malak, 1720 N. Prospect Ave., Milwaukee, Wis. 53202

[21] Appl. No.: 751,700

[22] Filed: Dec. 17, 1976

[51] Int. Cl.[2] ..... G21F 5/04

[52] U.S. Cl. ..... 250/505; 250/511; 250/513

[58] Field of Search ..... 250/505, 511, 512, 513, 250/514

[56] References Cited

U.S. PATENT DOCUMENTS

| | | | |
|---|---|---|---|
| 3,448,270 | 6/1969 | Peyser | 250/513 |
| 3,609,370 | 12/1969 | Peyser | 250/511 |
| 4,034,228 | 7/1977 | Arauner | 250/511 |

*Primary Examiner*—Archie R. Borchelt
*Attorney, Agent, or Firm*—Stephen P. Malak

[57] ABSTRACT

A collimator for use with a beam of radiation, and in particular, for use in controlling the cross-sectional size and shape of the radiation beam and intercepting undesired off-focus radiation in an x-ray apparatus. The collimator is adapted to be positioned adjacent the source of radiation and embodies a plurality longitudinally extending leaves pivotally mounted on and between two supports, the leaves moveable about their pivots to close overlapping relation to effectively define a hollow cone. The cone defines an aperture at its narrow end which can be adjusted in size and shape by rotation of the two supports which are adaptable to being moved one relative to the other, to thereby cause an expansion or contraction of the hollow cone and correspondingly an increase or decrease of the cross-sectional size and/or shape of the radiation beam passing through the aperture.

30 Claims, 33 Drawing Figures

RADIATION COLLIMATOR FOR USE WITH HIGH ENERGY RADIATION BEAMS

BACKGROUND OF THE INVENTION

The present invention relates to a radiation collimator for high energy radiation beams, and in particular to a collimator for use in x-ray systems used primarily for diagnosis and treatment of the human body.

In the use of x-ray systems on the human body it is desirable that the beam of radiation, which impinges on the subject, be narrowly confined to the specific area of interest or treatment and prevented from impinging on other areas which might be damaged by undesirable radiation. Such undesirable radiation is emitted from off-focal spots in the x-ray generating tube. It has been found that such off-focus radiation can be best controlled and prevented from passing through subsequent collimator shutter devices by positioning collimator radiation absorbing elements as closely as possible to the x-ray tube generator. This permits greater control over the cross-sectional size and shape of the beam of radiation.

A number of radiation collimator structures have been designed to solve this problem; a few are described in U.S. Pat. Nos. 3,448,270; 3,127,514; 3,609,370; 3,304,427; 3,023,324; and 3,156,824. One problem with these collimator devices is that they are very complicated arrangements of radiation absorbing shutter elements which usually take the form of a pyramidal shape, which is adjustable to effect an increase or decrease in an aperture defined by the narrow end of the pyramid. In addition, the structural support for these radiation absorbing elements being complex introduces problems in controlling and minimizing the erosion of the elements at their surface areas of contact as they operate with one another. Accordingly, such prior art devices have a high manufacturing cost, are difficult to repair and replacement of parts is a time-consuming effort.

SUMMARY OF THE INVENTION

It is therefore the general object of this invention to provide a radiation collimator of simple construction which has a low manufacturing cost, is easy to assemble and permits easy and low-cost repair and maintenance.

In general the radiation collimator of the present invention comprises a collimator structure positioned to intercept a beam of radiation from an x-ray apparatus close to the location of actual x-ray radiation generation. The collimator structure includes a base support defining a support space and having located therewithin a leaf support structure. A plurality of longitudinally extending leaves made of radiation absorbing material are mounted on the leaf support structure and within the support space. Each leaf is supported on the leaf support in such manner to permit the leaves to contact in close overlapping relation to effectively define a hollow cone which intercepts the beam of radiation. The narrow end of the cone defines an aperture through which a portion of the radiation beam is allowed to pass. The leaves can be mounted on the leaf support in a fixed relation to maintain a constant cross-sectional size and shape of the collimated beam, or the leaves can be pivotally mounted on the leaf support between two end supports which are adaptable to being moved one relative to the other to allow the leaves to be adjustable to define a varying size hollow cone so as to permit regulation of the size and/or shape of the aperture.

An additional object of the invention is to provide a radiation collimator which permits positioning the leaves of the collimator structure closer to the window of the x-ray tube than possible with prior art devices and eliminates secondary or off-focal spot radiation from passing through the radiation collimator structure.

Another object of this invention is to provide a radiation collimator having radiation absorbing leaves arranged and operable so as to reduce and minimize erosion and friction in their operation with each other.

A further object of the invention is to provide a radiation collimator having fixed or adjustable radiation absorbing leaf elements arranged in a hollow cone or pyramidal fashion for regulating the cross-sectional size of the collimated beam and the cross-sectional shape of the beam.

Another object of the present invention is to provide a radiation collimator which can rotate and position the cross-sectional shape of the collimated radiation beam with respect to the longitudinal axis of the radiation beam.

A further object of the present invention resides in the use of a support base for the collimator structure which permits the exchange of a collimator having a specified focal point and/or rate of aperture change with a collimator structure having a different focal point or rate of aperture change without necessitating the replacement or change of the support base.

A further object of the invention provides for a radiation collimator with support means that is easily adjustable to align the longitudinal axis of the collimator with the longitudinal axis of the beam of radiation.

A still further object of the invention provides for a radiation collimator with a single manual or electrical control which simultaneously adjusts the radiation collimator to a desired aperture with a pair of downstream plate-like shutter elements to a desired radiation beam cross-sectional size or shape.

An additional object of the invention is to provide a radiation collimator with radiation absorbing elements and support structure that has a low manufacturing cost, is simple to assemble and operate, and is easy to replace and maintain.

BRIEF DESCRIPTION OF THE DRAWINGS

With reference to the above objects of the invention and other objects and advantages which will appear in the following description taken in connection with the accompanying drawings.

DESCRIPTION OF THE PREFERRED EMBODIMENT

Figure 1:
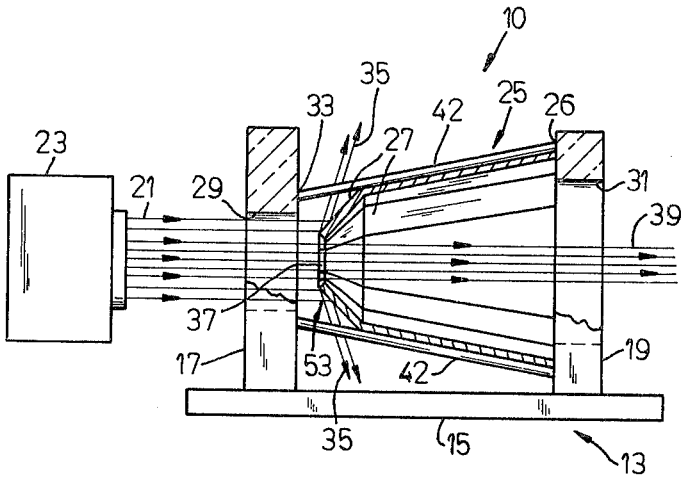
FIG. 1 is a side elevation view, partially in section, of the radiation collimator of the present invention, having a fixed aperture.

Referring in particular to the drawings, FIG. 1 shows the present invention in its simplest form to be a very compact construction. The radiation collimator is generally indicated at 10 positioned to intercept a beam of radiation 21 emanating from a radiation source 23. The collimator 10 comprises a support means 13 including a base 15 and a first leaf support 17 and a second leaf support 19. The leaf supports 17 and 19 define a support space 25 within which a plurality of longitudinally extending leaf elements 27 of radiation absorbing material are located and mounted at preselected diameter circles 33 and 26 on the leaf supports 17 and 19 respectively. Each diameter circle is concentric about the longitudinal axis of the radiation beam. The leaf elements 27 are fixedly mounted, one each to a leaf support rod 42. The support rods are longitudinally aligned with the longitudinal axis of the radiation beam and have their ends equispaced around the diameter circles 33 and 26. The leaf elements 27 overlap each other, similar to that shown in FIG. 20, to define a hollow cone 53 hereinafter generally referred to as the collimator structure in this specification.

The leaf supports 17 and 19 have passages 29 and 31, respectively, to permit passage of the beam of radiation 21. The radiation beam 21 will impinge upon the leaf elements 27 and some will be absorbed and some deflected as at 35. The remaining portion of the beam, the collimated beam of radiation 39, will pass through the aperture 37 defined by the leaf elements 27 at the narrow end of hollow cone 53.

As shown in FIG. 1, the leafs 27 are indicated as fixedly mounted to the leaf supports 17 and 19. In this configuration the beam of collimated radiation 39 will be maintained at a constant cross-sectional size and shape. It is desirable, however, to be able to vary the collimated beam of radiation in both size and shape as required for a particular end use.

Figure 2:
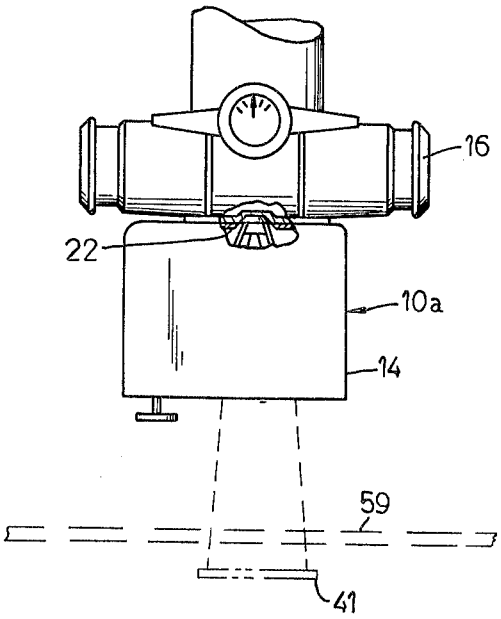
FIG. 2 shows the radiation collimator of the present invention mounted on the casing of an x-ray tube in operative relation to a table and x-ray radiographic film which are represented by dotted lines.

To achieve this an alternate embodiment is shown in FIG. 2 which shows a variable radiation collimator 10*a* of the present invention located in a housing 14 mounted on the casing of an x-ray tube 16 in operative relation with an x-ray table 59 and x-ray radiographic film 41.

Figure 3:
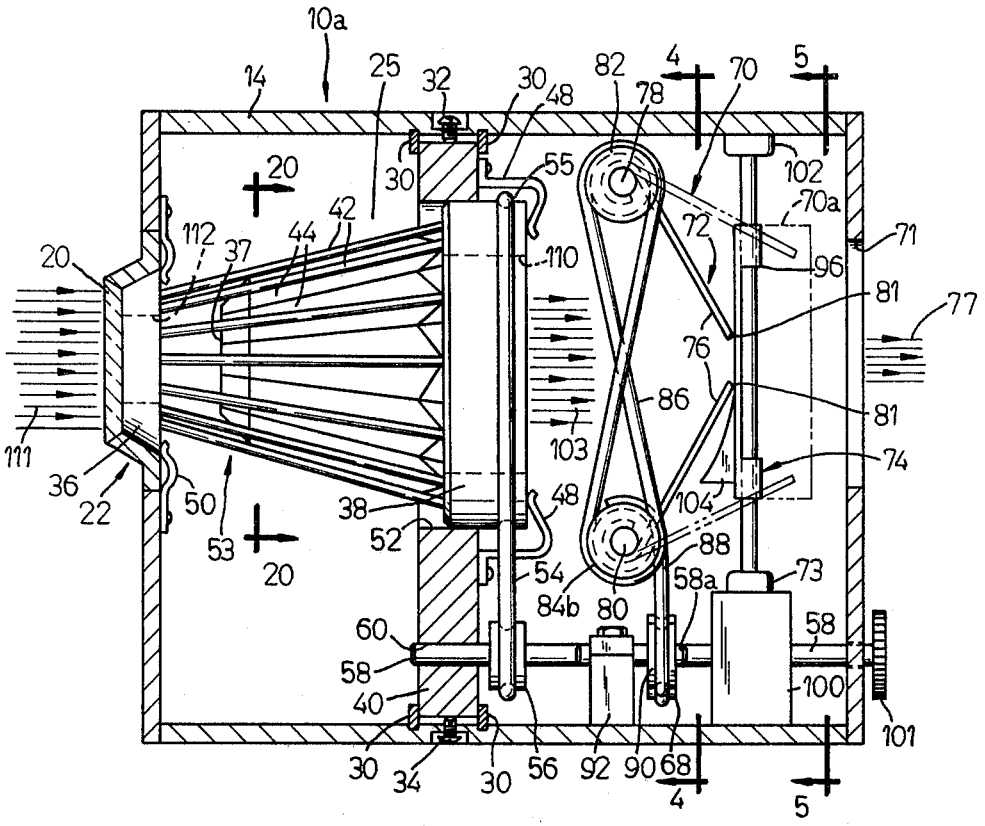
FIG. 3 is a side elevation section view of the radiation collimator of the present invention having a variable aperture.

FIG. 3, more particularly, shows the radiation collimator 10*a* enclosed in the generally rectangular housing 14 having in one wall an x-ray window 22 permitting passage of the radiation beam 111 from the x-ray tube 16. The x-ray window is recessed to fit within the recessed portion of the x-ray tube generator 16. The window 22 is made of x-ray transparent material and is cup-shaped to receive a first leaf support 36 held in position by spring clips 50. The leaf support 36 can be frustro-conical in shape and is preferably made of x-ray absorbing material. Support 36 has a circular passage 112 extending therethrough to permit passage of the radiation beam 111 indicated by the series of parallel lines having arrows showing the direction of radiation flow.

Figure 7:
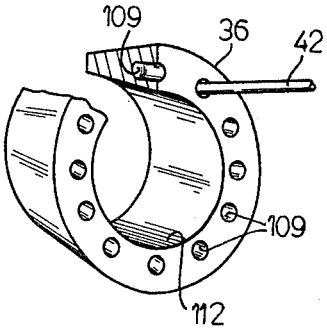
FIG. 7 is a perspective view of the first leaf support structure in detail.
Figure 8:
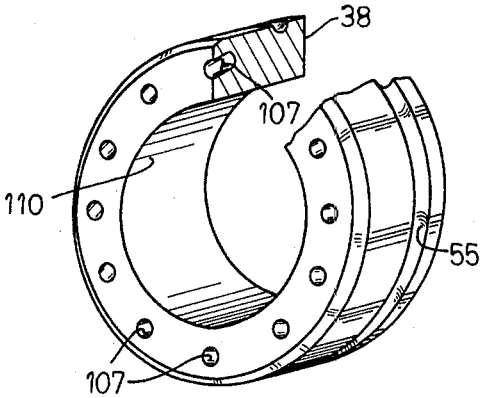
FIG. 8 is a perspective view of the second leaf support structure in detail.

The leaf support 36 is shown in perspective detail in FIG. 7 and has therein a plurality of bores 109, equal in number to the desired number of leaves to be used, and positioned on a diameter circle concentric with the longitudinal axis of the collimated beam of radiation. Each bore 109 has operating with it the end portion of a single leaf support rod 42, only one shown for simplification. The bore is sufficiently larger in diameter than the rod diameter to permit the rod to pivot universally within and at the bottom of the bore. The leaf support rods 42 are supported at their other end in similarly structured bores 107 located within a second leaf support 38 see FIG. 8. The end of each rod can be rounded for better pivoting operation within each bore. The end of each rod and its operation with a bore on the leaf support constitutes one pivot means structure for the leaf elements of the present invention.

Figure 9:
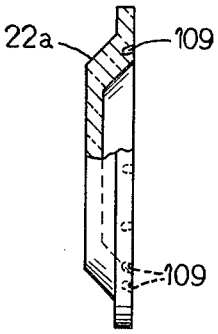
FIG. 9 is a side elevation view partially in section of the first leaf support structure showing it integral with the window of the x-ray tube generator.
Figure 10:
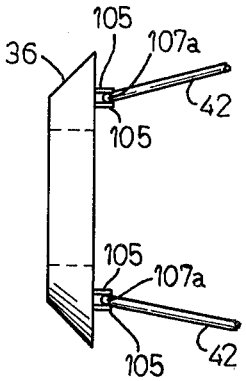
FIG. 10 is a variation of the leaf support pivot structure showing a ball joint connection.

The longitudinal axis of bores 107 and 109 will define an angle with respect to the longitudinal axis of the radiation beam, and this angle will depend on the length of rods 42 mounted between supports 36 and 38, and the diameter circles on which the rods are equispaced. Alternate pivot means structures are shown in FIGS. 9 and 10. FIG. 9 shows the leaf support 36 as being integral with the x-ray window 22. The pivot means consists of a plurality of bores 109 in window 22 and their operation, one each with the ends of support rods 42. The bores are equispaced on a diameter circle concentric with the longitudinal axis of the beam of radiation. FIG. 10 shows the pivot means comprising a ball joint connection, the ball joint constituting a ball portion 107*a* formed on the end of rod 42, which ball cooperates with a pair of fingers 105 fixed at diameter circles on the respective leaf supports 36 or 38. The ball is forced between and in frictional engagement with the fingers 105 which maintain a holding biasing force on the ball. In this manner the rod 42 can be universally mounted with respect to both leaf supports. Other variations of pivot means well known in the art and adaptable to the present invention can be used and these are contemplated as being within the scope of this invention.

Referring back to FIG. 3, there is located at the other end of the support rods 42 a cylindrical second leaf support 38 rotationally mounted within a bore 52 in support plate 40. The leaf support 38 has a passage 110 to permit the collimated beam of radiation 103 to pass therethrough. The plate 40 is fixed within housing 14 between mounting strips 30 that extend along the width of the housing. The centerline of bore 52 can be aligned with the collimated beam of radiation 103 by adjusting screws 32 and 34. The plate 40 has thereon a plurality of spring clips 48 to bias the leaf support 38 in contact with leaf support rods 42. Plate 40 also has a bore 60 for receiving a control shaft 58 which projects through housing 14 at one end. The control shaft is rotated manually by the operator by turning knob 101 which in turn rotates a pulley 56 fixed at the other end of the control shaft and which pulley is aligned with a groove 55 on leaf support 38. A belt 54 provides the operating connection between pulley 56 and leaf support 38. Although a manual control drive of pulley 56 is depicted, it can be operated and rotated by electric drive means well known in the art. Other variations and modes of drive well known in the art and adaptable to the present invention and not shown are contemplated within the scope of this invention.

Figure 20:
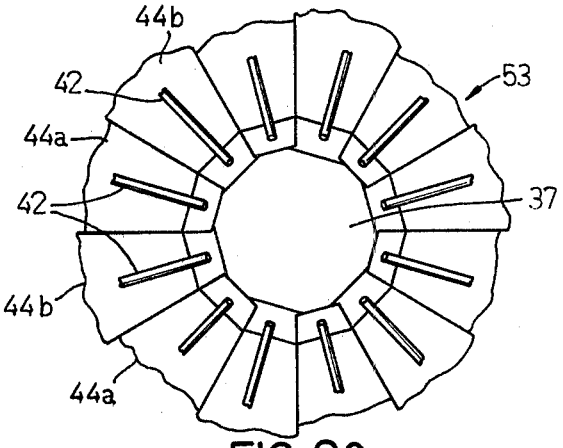
FIG. 20 is an end cross-section view taken along lines 20—20 of FIG. 3, showing the overlapping arrangement of the inner and outer leaf elements.

The leaf support rods 42 have fixed on them leaves 44 (to be described in detail later at FIGS. 11 through 18). The leaves 44 are made of radiation absorbing material and are arranged to overlap one another as shown in FIG. 20. The leaves 44 are arranged such that there results an inner set of leaves 44*b* overlapped by an outer set of leaves 44*a*. Together both set of leaves define the pyramidal or hollow cone 53.

In particular as shown in FIG. 20, each inner leaf 44*b* is overlapped closely at each of its edges by a portion of the edge of the adjacent outer leaf 44*a*. Consequently, the hollow cone comprises an inner leaf, outer leaf, inner leaf, etc. around its periphery. This hollow cone structure 53 can be made to terminate closely to the x-ray window 22 so as to intercept off-focus radiation as closely as possible to the source of radiation.

Figure 19:
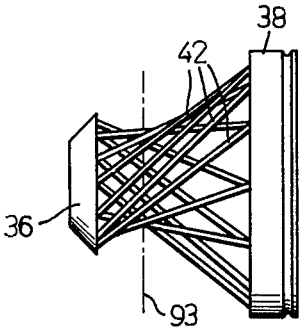
FIG. 19 is a side sectional view of the radiation collimator showing the change in leaf aperture when one leaf support is rotated relative to the other leaf support.

A reference starting position is defined as the maximum length of support space 25 between supports 36 and 38, which maximum is determined by the selected length of leaf support rods 42, with the leaf support rods 42 in longitudinal alignment with the longitudinal axis of the radiation beam 103. Beginning at the starting position, the collimator structure is operated as follows. The operator manually rotates knob 101 causing pulley 56 to drive belt 54 and rotate outer leaf support 38. With the leaves 44 pivotally mounted on leaf supports 36 and 38, the support rods 42 will be forced to rotate simultaneously about the longitudinal axis of the radiation beam in three dimensions. Rotation of leaf support 38 relative to fixed leaf support 36 will cause the support space 25 to reduce in length due to the rotation of leaf support rods 42 out of alignment with the radiation beam axis. With the operating distance between leaf supports reduced, leaf support 38 must be able to move slightly in the direction of leaf support 36 to maintain operative contact with the ends of support rods 42. This is achieved by the use of springs 48 which provide a biasing force on leaf supports 38 in the direction of leaf support 36. (See FIG. 3.) For simplification a schematic of the collimator (showing only support 36, support 38, and support rods 42) indicated in FIG. 19 shows that as the support rods 42 are rotated from the starting position they begin to collapse or converge with respect to each other to what is now referred to as the focal plane of the collimator, indicated by the dotted line at 93. Collapse of the support rods 42 concomitantly forces the leaves 44 to move inwardly to define a more narrow end hollow cone. This establishes a smaller aperture 37 and accordingly a smaller cross-sectional area of the collimated beam of radiation 103 passing through the cone. Consequently, the beam of radiation 111 directed against the hollow cone will be absorbed and deflected by the outer surfaces of the leaves 44, except for that portion of the beam passing through aperture 37.

Leaf support 38 can be rotated in either direction unitl the leaves 44 collapse to the point of completely closing aperture 37 or at the point where the leaf support rods 42 all contact each other at the focal plane. Which of these occurs first depends primarily on the design of leaf 44. Rotation of the support 38 in the opposite direction from where the leaves are completely collapsed will cause the support rods to rotate toward alignment with the axis of the beam of collimated radiation and simultaneously move the leaves outwardly increasing the size of aperture 37 to its maximum area at the starting position.

Figure 21:
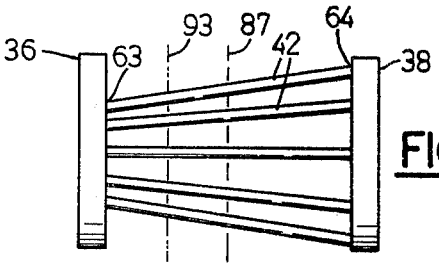
FIG. 21 is a side schematic view of the collimator showing the first support maintaining the leaf elements at a diameter circle less than the diameter circle on the second support.
Figure 22:
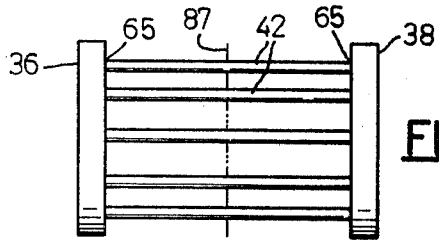
FIG. 22 is a side schematic view of the radiation collimator showing the leaf supports connecting the leaf elements at equal diameter support circles.
Figure 23:
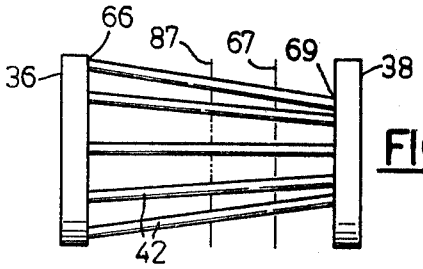
FIG. 23 is a side schematic view of the radiation collimator showing the first leaf support connecting the leaf elements at a diameter support circle greater than the diameter circle on the second support.

FIGS. 21, 22, 23, 24 and 25 show in schematic form the supports 36 and 38 and support rods 42. FIG. 21 shows the support rods 42 operating with leaf support 36 on a diameter circle 63 smaller than the diameter circle 64 on leaf support 38. The plane of collapse 93 is to the left of the centerline 87 between the two leaf supports. FIG. 22 shows the rods 42 operating on equal diameter circles 65 on leaf supports 36 and 38. The focal plane of collapse of the rods 42 is the centerline 87. FIG. 23 shows the rods 42 operating with leaf support 36 on a diameter circle 66 greater than the operating diameter circle 69 on leaf support 38. The focal plane of collapse 67 is to the right of the centerline 87. Accordingly, the operating diameter circle of the rods with either leaf support can be selected depending on the desired location of the focal plane and the collapse of rods 42. This permits selecting the plane of collapse of the leaves. In addition, for a given selected leaf configuration and selected mounting location on the rods, the rate of collapse of the leaves inwardly for a given turn of leaf support 38 will increase as one proceeds from the structure in FIG. 21, to FIG. 22, to FIG. 23.

Figure 24:
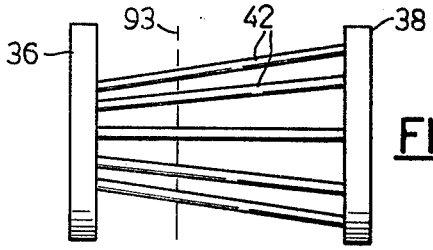
FIG. 24 is a side schematic view of the radiation collimator showing the focal plane of the aperture.
Figure 25:
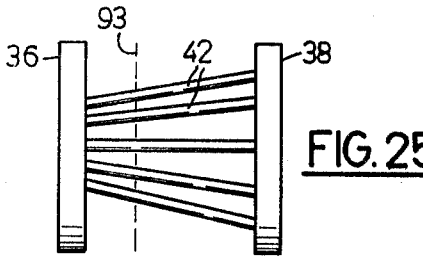
FIG. 25 is a side schematic view of the radiation collimator showing the focal plane shifted longitudinally, with respect to that shown in FIG. 24.

An alternative to changing the rate of collapse of the leaves can be achieved by increasing or decreasing the length of the support rods (or support space 25) as shown in FIGS. 24 and 25. For a given turn of leaf support 38 with respect to support 36, the rods will collapse at a slower rate in FIG. 24 than those in FIG. 25. It is apparent then that a precise degree of control over the rate of increase or decrease in the cross-sectional area of the collimator aperture 37 is attainable by a simple collimator having a minimum of structure occupying a minimum amount of space.

Since the operating diameter circle for each leaf support can be varied depending on the desired location of the focal plane and desired rate of collapse of the cross-sectional area of aperture 37, it is possible to use a standard housing 14 having fixed supports 36 and 38. This permits varying the operating diameter of each leaf support and the rate of collapse of the leaves by simply exchanging one collimator structure consisting of one set of leaf supports 36 and 38 and rods 42, with another collimator structure having leaf supports 36 and 38 with different operating diameter circles and with different configuration leaves.

Additionally, by making the plate 40 moveable from one fixed position in housing 14 to another fixed position so that the longitudinal axis of bore 52 is moved along the axis of the beam of radiation, it is possible to insert a different length of rod 42 as desired and achieve the structure shown in FIGS. 24 and 25. The collimator structure thereby provides easy and modification of any one of its component elements.

Figure 26:
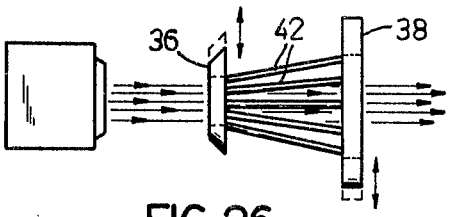
FIG. 26 is a side schematic view of the radiation collimator showing how the first and second supports of the collimator can be shifted to align the longitudinal axis of the hollow cone with the longitudinal axis of the beam of radiation.

Further, by making the leaf support 36 similarly adjustable within housing 14 as described for plate 40, it is possible (see FIG. 26) to precisely adjust and align the longitudinal axis of the hollow cone 53 to be in alignment with the centerline longitudinal axis of the collimated beam of radiation 103. Such adjusting structure for leaf support 36 is not shown since any one of a number of ways is possible and obvious to those skilled in the art.

The leaves can be made to any thickness and to any desired configuration as long as it is possible to mount them on the support rods in overlapping operative relation. With very thick leaf elements 44 it might be necessary to mount the support rods 42 for the outer leafs **44*a* at a diameter circle on support 36 larger than the diameter circle for inner leafs 44*b* to compensate for the leaf thickness. This is similarly true for support 38**.

Figure 11:
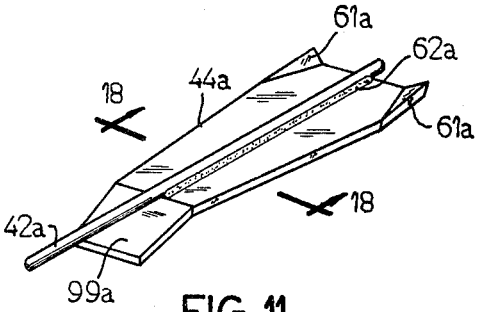
FIG. 11 is a detail view of one form of the collimator outer leaf element depicted in FIG. 3.

One configuration for the outer leaf element **44*a* is shown in FIG. 11 where the leaf is formed as a substantially flat elongated plate-like element the planes of which are disposed at its narrow end 99*a* at a slight angle with respect to the longitudinal axis of the leaf. The other end of leaf 44*a* may have its corners 61*a* bent slightly to provide smooth cooperative clearance with leaf element 44*b*. Leaf 44*a* is fixed to rod 42*a* at 62*a***.

Figure 12:
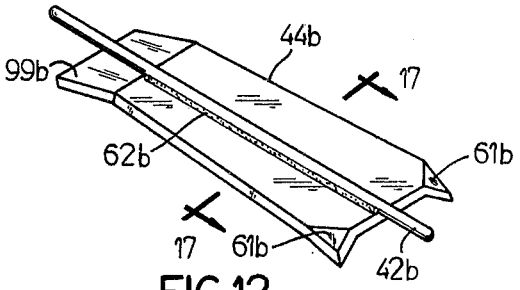
FIG. 12 is a detail view of one form of the collimator inner leaf element depicted in FIG. 3.
Figure 13:
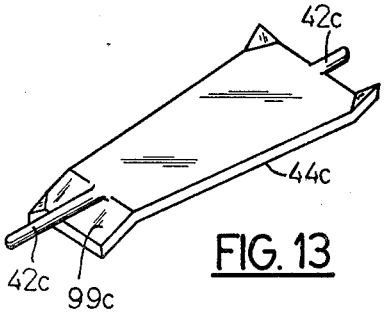
FIG. 13 is a variation of the collimator leaf element showing the leaf integral with its end the pivot supports.

A configuration for the inner leaf element **44*b* is shown in FIG. 12 where the leaf is formed as a substantially elongated flat plate-like element the planes of which are disposed at its narrow end 99*b* at a slight angle with respect to the longitudinal axis of the leaf. The other end of the leaf may have its corners 61*b* curved slightly to provide smooth cooperation with the curved corners 61*a* of leaf element 44*a*. Leaf 44*b* is fixed at 62*b* to rod 42*b*. Another configuration for the leaf element 44 is shown in FIG. 13 where the flat elongated leaf 44*c* is made integral with its end pivot supports 42*c***.

Figure 17:
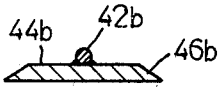
FIG. 17 is a cross-sectional view of the inner leaf element taken along lines 17—17 of FIG. 12.
Figure 18:
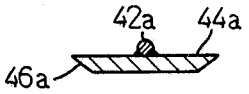
FIG. 18 is a cross-sectional view of the outer leaf element taken along lines 18—18 of FIG. 12.
Figure 15:
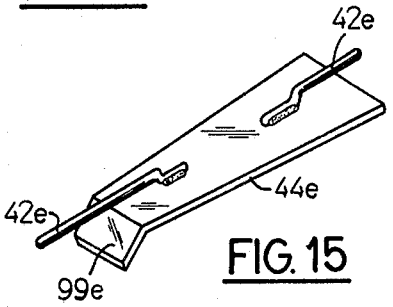
FIG. 15 is another variation of the collimator leaf element showing pivot rods mounted at the mid-portions of the leaf element.
Figure 14:
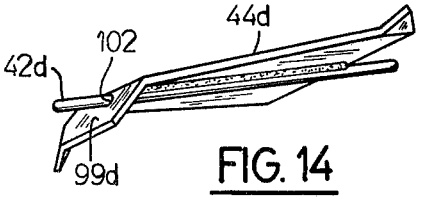
FIG. 14 is another variation of the collimator leaf element showing a portion of the leaf on both sides of the support rod.
Figure 16:
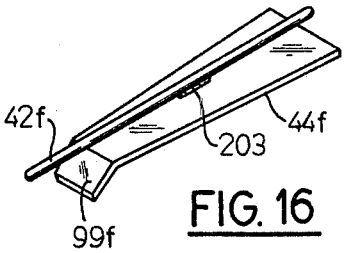
FIG. 16 is another variation of the collimator leaf element showing the pivot rod mounted at the center of the leaf element.

FIG. 14 shows a method of mounting the support rod **42*d* to leaf element 44*d* such that the rod is inserted through an opening 102 in the end leaf portion 99*d* so that the leaf portion 99*d* projects below the support rod while the remaining portion of the leaf is mounted above the support rod. FIG. 15 shows a variation of the support rod 42*e* which is shown as two parts and mounted close towards the center of the leaf element 44*e* away from the end edges of the leaf. FIG. 16 shows the support rod 42*f* mounted on the leaf 44*f* substantially only at the center portion 203 of the leaf 44*f*. FIG. 17 is a cross-section of the inner leaf 44*b* of FIG. 12 showing how the edges 46*b* can be beveled for better sliding cooperation with the outer leaf element 44*a* shown in FIG. 11. FIG. 18 is a cross-section of the outer leaf element 44*a* showing an oppositely angled bevel 46*a* at its edges which cooperate with bevel 46*b* to provide a close sliding relation with leaf 44*b***. Other configurations of the leaf element and different support rod structures are contemplated as coming within the scope of this invention.

An advantage of the collimator structure of the present invention is apparent when the leaves are made of an efficient x-ray absorbing material such as lead. The only area in which they come in frictional contact with the adjacent leaf is at the edges of their point of overlap. This is important since lead is a soft material that easily erodes. The collimator accordingly minimizes the contact area of leaf overlap and thereby leaf erosion. Leaf erosion is minimized due to the close overlapping contact that can be maintained between the leaves as they are mounted on leaf supports 36 and 38. It is possible, however, to have the leaves overlap in tight frictional contact. This is achieved by mounting the outer leaves **42*a* on their support rods 42 at diameter circles on supports 36 and 38, respectively, so that they exert a spring bias force on the adjacent inner leaves 44*b*. The inner leaves will react with a similar but oppositely acting biasing force against the outer leaves. The spring bias acts from the support rods 42** having a longitudinal bending force applied at their ends due to the diameter circles on which they operate. With this arrangement a preselected amount of frictional force can be designed to act between the cooperating leaves. If erosion occurs between the leaves, it is simply compensated for by the spring bias force acting between the adjacent cooperating leaves. If a leaf erodes to the point that leakage of radiation occurs, the leaf can be easily removed and a new leaf and support rod inserted at the site of operation of the x-ray apparatus.

Figure 27:
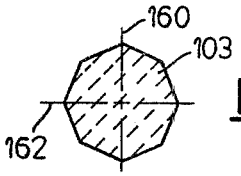
FIG. 27 is a view of one form of the cross-sectional area of the collimated beam of radiation as it exits the radiation collimator and before it passes through the plane-like shutters.
Figure 28:
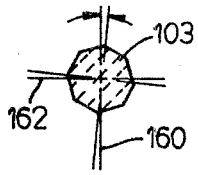
FIG. 28 is a view of the cross-sectional area of the collimated beam of radiation shown in FIG. 27 reduced in size upon rotation of one leaf support relative to the other.
Figure 29:
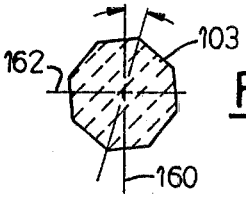
FIG. 29 is a view of the cross-sectional area of the collimated beam of radiation showing its shape rotated relative to the longitudinal axis of the collimated beam.
Figure 30:
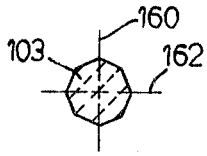
FIG. 30 is a view of the cross-sectional area of the collimated beam of radiation of FIG. 28 showing the shape of the beam rotated in alignment with the reference axis.
Figure 31:
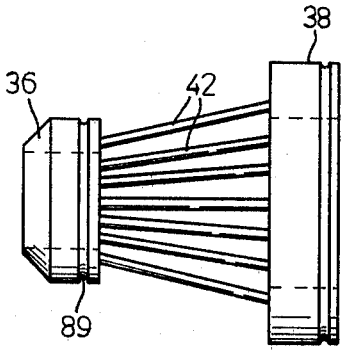
FIG. 31 is a schematic view of the radiation collimator showing a modification of the first leaf support necessary to achieve rotation of the beam cross-sectional shape.

FIG. 27 shows an end view of the cross-sectional area of the beam of collimated radiation 103 as it passes through aperture 37 when the support rods 42 are in longitudinal alignment with the longitudinal axis of the beam. The shape of the cross-sectional area of the beam of collimated radiation 103 will depend on the number of leaves used and the shape of the end leaf portion defining the aperture. The centerline reference axes 160 and 162 shown are parallel to the sides of the housing 14 and are given for reference purposes only. FIG. 28 shows the reduction in cross-sectional area of the collimated beam when the support 38 is rotated slightly with respect to the fixed support 36. It is apparent that the peripheral shape of the beam also turns slightly away from the reference axes due to the rotation of the leaves 44. FIG. 29 shows how the cross-sectional area of the collimated beam shown in FIG. 27 can be kept constant but rotated with respect to the reference axes. Similarly FIG. 30 shows how the reduced cross-sectional area of the beam of FIG. 28 can be made to align its peripheral shape similar to that shown in FIG. 27. The rotation of the cross-sectional shape of the beam to a desired position with respect to the reference axes is possible by using a support 36 as shown schematically in FIG. 31. In essence the support 36 is made to operate similarly to support 38. Support 36 can have a groove 89 formed on it with which a drive belt can be made to operate with a separate drive means and control shaft similar to that described for support 38. In view of the previous description of the control means for support 38, a detailed description of this is not necessary as being obvious to those skilled in the art. In this arrangement leaf support 36 is made to be rotatable either in window 22 or with its own support plate similar to plate 40. The result is that both leaf supports 36 and 38 are independently mounted for rotation about the longitudinal axis of the radiation beam and can be independently controlled for rotation. Accordingly, if the support 36 is turned simultaneously in the same direction and the same amount as support 38 then a constant cross-sectional area of the beam 103 can be made to rotate as shown in FIG. 29. In addition, since the cross-sectional shape of the beam 103 in FIG. 28 is rotated slightly by rotation only of support 38, it is possible to realign the beam shape to that shown in FIG. 30 by rotation of both supports 36 and 38 in the opposite direction the same amount.

Figure 4:
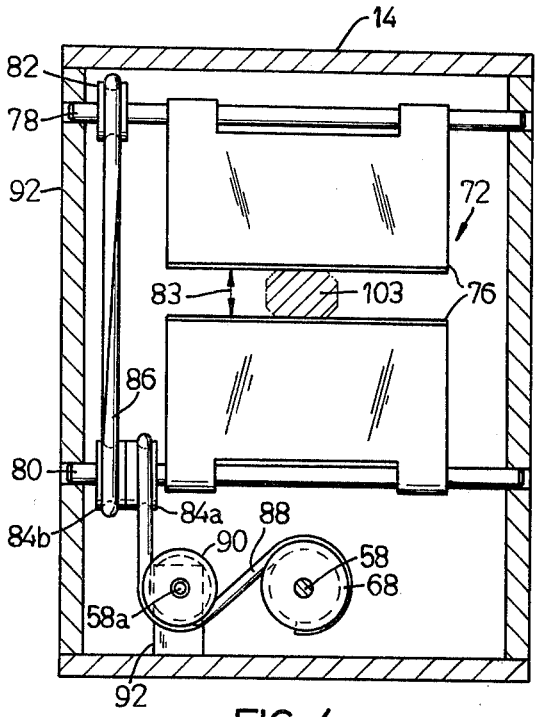
FIG. 4 is an end sectional view of the radiation collimator device taken along lines 4—4 of FIG. 3 showing the first pair of plane-like shutter elements.
Figure 5:
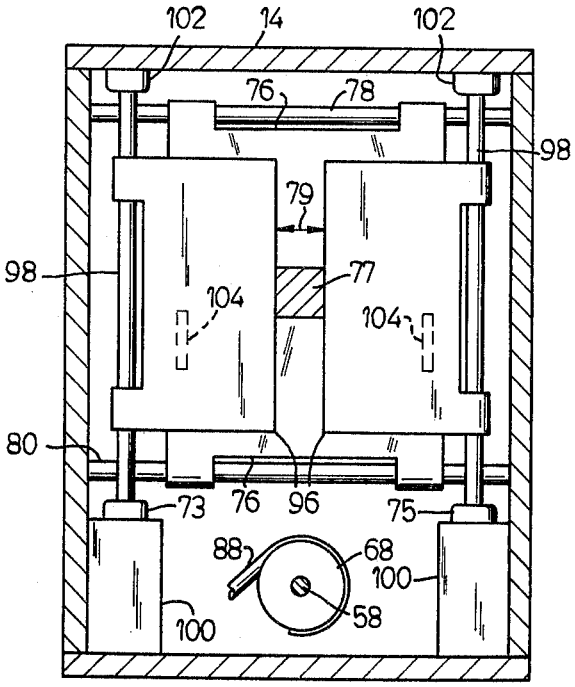
FIG. 5 is an end sectional view of the radiation collimator taken along lines 5—5 of FIG. 3 showing the second pair of plane-like shutter elements.
Figure 6:
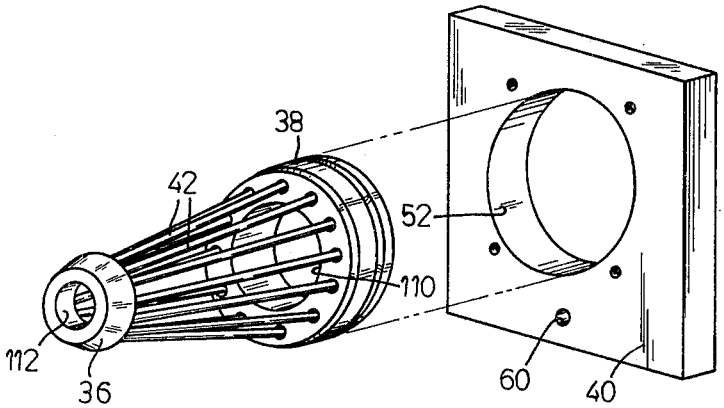
FIG. 6 is a perspective view of the first and second leaf supports depicted in FIG. 3.

The present invention, therefore, provides for adjusting the peripheral shape of the collimated beam with respect to the downstream plate-like shutter elements 72 and 74 as shown in FIGS. 3, 4, and 5 to be discussed later.

Figure 32:
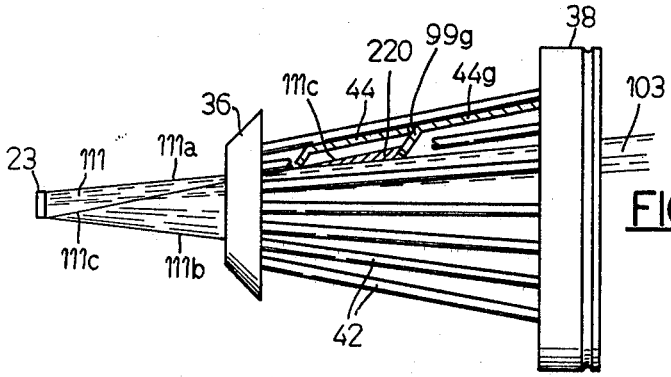
FIG. 32 is a variation of the radiation collimator leaf elements showing the use of a series of leaves mounted on each leaf support rod.

A variation of the radiation collimator is depicted in schematic form in FIG. 32. Shown are leaf supports 36 and 38 and leaf support rods 42. Mounted in series on each leaf support rod 42 are two leaves 44 resulting in a collimator having two hollow cones 53 defined within support rods 42. The advantage this provides is the thickness of the leaves can be made thinner and by operating in substantially a series fashion provide the minimum thickness of radiation absorbing material necessary to stop the radiation beam 111 from passing through the collimator except for that portion which passes through the apertures of the narrow end of the hollow cones. Obviously, any number of leaves can be mounted on each support rod by merely extending the length of the rod.

Another advantage the structure shown in FIG. 32 provides is the elimination of the penumbra 220 that usually occurs with cone type collimators. The penumbra is a problem since it consists of off-focus (shadow) radiation that could be difficult to control later and which, if not eliminated, will exit the collimator housing and undesirably impinge on target areas not of specific interest or concern.

The penumbra 220 as shown in FIG. 32 is a radiation shadow cone-shaped in cross-section and defined around the main collimated beam of radiation 103. The penumbra results from radiation emanating in many different directions from substantially the same location at the radiation source 23. This is depicted by radiation beams **111*b* and 111*c* emanating from the same location at source 23**.

The cone-shaped penumbra will be defined at one location where, for example, radiation beam **111*a* emanating from one end of source 23 and radiation beam 111*c* emanating from another end of source 23 pass through the aperture of the first hollow cone 53 defined by leaves 44, at substantially the same location. The resulting penumbra 220 will be defined between radiation beams 111*a* and 111*c***.

However, by use of a second set of leaves **44*g* mounted in series with leaves 44 on support rods 42, a second hollow cone 53 is defined having the forward ends 99*g* of its leaves 44*g* so constructed that they intercept the undesirable penumbra 220 and only permit passage of the desired collimated beam 103. In addition, since the two hollow cones 53 are mounted on the same support rods, the cones will collapse with respect to each other (upon rotation of supports 36 and 38 one relative to the other) such that the penumbra 220 is uniformly intercepted through all changes of the cross-sectional area of the collimated beam 103 and thereby provide a collimated beam 103** substantially free of any penumbra which is not possible by prior art devices.

Referring back to FIGS. 3, 4 and 5, in addition to the collimator 10 as hereinbefore described, there can be operatively associated downstream two pairs of plane-like shutter elements. The plane shutters 72 will be referred to as the "cross-shutters" and the other pair of shutters 74 the "long-shutters." These plane shutters are depicted here for the same purposes as used in the prior art, one example being disclosed in U.S. Pat. No. 3,609,370.

Each pair of plane shutter elements 72 and 74 is adapted to limit the cross-sectional size of the collimated beam 103 in one dimension. The cross-shutter 72 comprises two plane elements 76 which may be adjusted relative to one another so that each intercepts opposed marginal portions of the collimated beam 103. The long-shutter elements 96 are similarly adjustable relative to each other to intercept opposed portions of the collimated beam in a second dimension. Both shutter elements 72 and 74 are operational by suitable mechanical or electrical means, a mechanical means shown for example only.

Referring to FIGS. 3, 4 and 5, belt 88 is fixed to partially wrap around pulley 68. Drive belt 88 operates around idler pulley 90 and is fastened at its other end to pulley **84*a* fixed on shaft 80 of the lower cross-shutter element 76. A second pulley 84*b* fixed on shaft 80 drives pulley 82 fixed on shaft 78 on which is mounted the upper cross-shutter element 76. Shafts 78 and 80 are suitably mounted for rotation in housing 14. Belt 86 is mounted crosswise (see FIG. 3) between pulley 84***b* and pulley 82 so that upon rotation of pulleys 84*b* and 82, the plates 76 either rotate toward each other or away from each other, as shown by the dotted lines 70 in FIG. 3. The cross-shutter elements 76 are operational with the long-shutter elements 74 through a cam 104 fixed on each lower long-shutter element 96. Each shutter element 96 is pivotally mounted for rotation on shafts 98 suitably mounted in bearing blocks 100 and 102 in housing 14.

The operation of the cross-shutters 72 and long-shutters 74 is best viewed in FIGS. 3 and 4. The operator rotates knob 101 clockwise causing belt 88 to rotate pulley 84*a* and 84*b* clockwise. Pulley 84*b* concomitantly rotates pulley 82 in an opposite direction since belt 88 is mounted crosswise. The cross-shutter elements 76 accordingly rotate relative to each other and away from each other to define a larger cross-shutter aperture 83 depicted 83 depicted in the end view of FIG. 4. Simultaneously with movement of cross-shutter elements 76, their edges at points 81 operate with the cams 104 to force the long-shutter elements 96 to rotate about their shafts and away from each other (see the dotted lines 70*a*) to define a larger long-shutter aperture 79 (see FIG. 5). Cross-shutter aperture 83 restricted by the long-shutter aperture 79 together define the cross-sectional area of the effective collimated beam aperture 77 exiting housing 14.

The long-shutter elements 96 are each spring-biased by torsional springs indicated at 73 and 75 on their respective shafts to a normally closed position which is the position where elements 96 define the minimum area long-shutter aperture 79. The torsional spring bias on the long-shutter elements 96 keep the elements 76 and 96 in constant operative association with each other through cams 104. Upon rotation of knob 101 counterclockwise, the torsional spring bias through cams 104 forces the cross-shutter elements 76 to rotate toward each other so as to narrow the cross-shutter aperture 83. This results in the combined effect of reducing aperture 79 and 83 thereby reducing the effective collimated beam aperture 77.

FIGS. 3, 4 and 5 as described depict a radiation collimator shutter apparatus in operation with plane shutters 72 and 74 all controlled by one control shaft 58 through one manually operated knob 101. It is also possible to control shaft 58 by suitable electric means.

Figure 33:
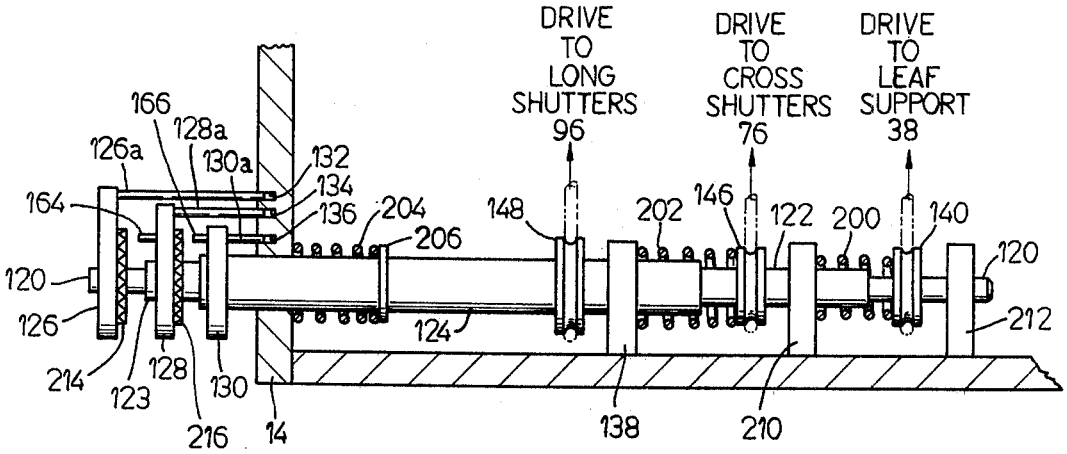
FIG. 33 is a sectional view of a variation of the manual control for the radiation collimator and downstream plate-like shutter elements.

An alternative to the manual control described above is shown in FIG. 33. In lieu of a single control shaft 58, three shafts each in telescoping relation with each other can be used. In this case each shaft individually drives the leaf support 38, cross-shutters 76 and long-shutters 96. Specifically, shaft 120 is rotatably telescoped within shaft 122, and shaft 122 in turn rotatably telescoped within shaft 124. Shaft 124 is rotatably mounted at one end in the end wall of housing 14 and at the other end in a bearing block 138. Shaft 122 is supported at its other end in bearing block 210, and shaft 120 is supported at its other end in bearing block 212. Shafts 120, 122 and 124 each extend out of housing 14 as shown and have each fixed thereon a control knob 126, 128 and 130, respectively. At their other end shafts 120, 122 and 124 have each fixed a pulley 140, 146 and 148, respectively, for individually driving (through suitable pulley means or other means not shown but obvious to those skilled in the art) the leaf support 38, cross-shutter elements 76 and long-shutter elements 96, respectively.

Each control knob 126, 128 and 130 has located on its side facing the housing a pin 126*a*, 128*a* and 130*a* for respective engagement with a plurality of holes 132, 134 and 136 circularly located and aligned with respect to each other on housing 14. The knobs 126 and 128 have fixed on the same side as their pins circularly formed rack teeth 214 and 216, respectively, which racks mate with pins 164 and 166 located on knobs 128 and 130, respectively.

Further, shafts 120, 122 and 124 are spring biased by springs 200, 202 and 204, respectively, so that the pins 126*a*, 128*a* and 130*a* engage with their respective holes 132, 134 and 136 in a normally fixed position. Spring 204 acts between fixed ring 206 on shaft 124 and the wall of housing 14. Spring 202 acts between pulley 146 on shaft 122 and the bearing block 138. Spring 200 acts between pulley 140 on shaft 120 and bearing block 210.

The control is operated as follows. Each control knob 126, 128 and 130 can be individually rotatably fixed to any one of a plurality of fixed positions in their respective mating holes 132, 134 and 136. This permits fixing each shaft at a desired setting by pulling outwardly slightly on each control knob away from the housing against their respective spring bias. The selected control knob can then be rotated as desired and released so that its pin engages with one of the mating holes in the housing. This permits the hollow cone 53, cross-shutters 76 and long-shutters 96 to each be individually positionable at a selected setting with respectively defined aperture openings. In addition, if the operator has each control knob set at a particular position and wishes to open or close all of them simultaneously and yet maintain their respective relative positions with each other, all he needs to do is pull knob 130 outwardly so that pin 166 engages with the rack teeth 216 on knob 128 and that pin 164 engages with the rack teeth 214 on knob 126. This causes all control knobs to be temporarily locked together. The operator can then rotate all three controls simultaneously to a new position and yet have them maintain their relative positions with respect to each other. Release of control knob 130 releases all knobs at the new position so that each becomes fixed in his respective mating holes 132, 134, and 136, it being understood that these holes are circularly located and aligned with each other on housing 14.

A similar but separate operation exists between knob 128 and knob 126 if the operator wishes to move them both simultaneously yet keep the control knob 130 fixed at its setting.

While I have shown and described the preferred embodiments, it is apparent that various modifications and changes to the structures and their mode of operation may be made by those skilled in the art without departing from the spirit and scope of the invention as defined in the accompanying claims. Therefore, the terms and expressions which have been employed are used as terms of description and not of limitation, with no intention of excluding equivalents of any of the features and with all descriptions and drawings to be interpreted as illustrative and not limiting in any sense.

I claim:

1. A radiation collimator for collimating a beam of radiation, comprising:

a base;

support means mounted on the base to intercept the beam of radiation and permitting passage of the beam of radiation, the support means including a first support and a second support defining a support space, the first support and the second support permitting passage of the beam of radiation; and a plurality of leaves of radiation absorbing material having pivot means for pivotal support on and between the first support and the second support, the leaves being moveable about their pivot means in close overlapping relation, to effectively define an aperture about the beam of radiation passing through the collimator.

2. A radiation collimator as recited in claim 1 wherein the first support is mounted on the support means for relative movement between a first position and a second position with respect to the second support, whereby movement of the first support to the first position effects an expansion of the aperture, and movement of the first support to the second position effects a contraction of the aperture, with a resulting increase and decrease, respectively, in the cross-sectional size of the radiation beam passing through the aperture.

3. A radiation collimator as recited in claim 2 further including first adjusting means operatively associated with the first support to permit aligning the passage through the first support with respect to the longitudinal axis of the beam of radiation passing through the passage.

4. A radiation collimator as recited in claim 3 further including second adjusting means operatively associated with the second support to permit aligning the passage through the second support with respect to the longitudinal axis of the beam of radiation.

5. A radiation collimator as recited in claim 2 wherein the second support is mounted on the support means for relative movement between a first position and a second position with respect to the first support, whereby movement of the second support with respect to the first support controls the rotation of the cross-sectional shape of the beam of radiation relative to the longitudinal axis between the first support and second support.

6. A radiation collimator as recited in claim 1 wherein the first support and the second support are mounted on the support means for relative movement with respect to each other.

7. A radiation collimator as recited in claim 1 wherein the pivot means comprises an elongated element secured to the leaf substantially along its longitudinal axis and extending past the ends of the leaf, the ends of each elongated element pivotally operating with the first support and second support, respectively.

8. A radiation collimator for collimating a beam of radiation, comprising:

a housing having passage means permitting passage of a beam of radiation directed toward the housing;

support means mounted in the housing to intercept the beam of radiation and defining a support space permitting passage of the beam of radiation therethrough;

a plurality of support rods mounted on the support means and within the support space and about the beam of radiation passing through the collimator;

a first set of longitudinally extending leaves of radiation absorbing material, one each secured to a portion of one of the support rods, the leaves being in close overlapping relation to effectively define a first hollow cone about the beam of radiation; and a second set of longitudinally extending leaves of radiation absorbing material, one each secured to a remaining portion of one of each of the support rods, the leaves being in close overlapping relation to effectively define a second hollow cone about the radiation beam.

9. A radiation collimator as recited in claim 8 further including means associated with the leaves to maintain them in close frictional relation at their areas of contact.

10. A radiation collimator as recited in claim 9 wherein the means maintaining the leaves in close frictional relation is spring bias means acting through the leaf support means for each leaf.

11. A collimator for use with an x-ray apparatus comprising:

a housing having a port for permitting passage of an x-ray beam;

first support means mounted on the housing adjacent the port and permitting passage of the x-ray beam;

second support means mounted on the housing so as to define a support space between the first support means and the second support means, the second support means permitting passage of the x-ray beam; and a plurality of longitudinally extending leaves of radiation absorbing material, each leaf having leaf support means for support on and between the first and second support means and within the support space, the leaves being in close overlapping relation to effectively define a hollow cone about the beam of radiation.

12. A collimator as recited in claim 11 further including means associated with the leaves to maintain them in close frictional relation at their areas of contact.

13. A collimator as recited in claim 12 wherein the means maintaining the leaves in close frictional relation is spring bias means acting through the leaf support means for each leaf.

14. A collimator as recited in claim 11 wherein the leaf support means is pivot means at each end of the leaves for pivotal support on and between the first support means and second support means, the leaves being moveable about their pivot means in close overlapping relation.

15. A collimator as recited in claim 11 wherein the first support means is mounted on the base for relative movement between a first position and a second position with respect to the second support means, whereby movement of the first support means to the first position effects an expansion of the hollow cone, and movement of the first support means to the second position effects a contraction of the hollow cone, with a resulting increase and decrease, respectively, in the cross-sectional size of the radiation beam passing through the hollow cone.

16. A collimator as recited in claim 15 further including first adjusting means operatively associated with the first support to permit aligning the passage through the first support with respect to the longitudinal axis of the beam of radiation passing through the passage.

17. A collimator as recited in claim 16 further including second adjusting means operatively associated with the second support to permit aligning the passage through the second support with respect to the longitudinal axis of the beam of radiation.

18. A collimator as recited in claim 15 wherein the second support means is mounted on the base for relative movement between a first position and a second position with respect to the first support means, whereby movement of the first support means with respect to the second support means controls the rotation of the cross-sectional shape of the beam of radiation with respect to the longitudinal axis of the radiation beam.

19. A collimator as recited in claim 11 wherein the first support means and second support means are mounted on the base for relative movement with respect to each other.

20. A collimator as recited in claim 14 wherein the pivot means comprises a support rod secured to each leaf substantially along the leaf longitudinal axis and extending past the ends of the leaf, the ends of the support rod, one each pivotally operating with the first support means and the second support means, respectively.

21. A radiation collimator for use with an x-ray apparatus comprising:

a housing positioned to intercept a beam of x-rays directed toward the housing, a first support means and a second support means mounted in the housing for relative movement with respect to each other and defining a support space between them, and a plurality of longitudinally extending leaves of radiation absorbing material having leaf support means at each end for mounting on and between the first and second support means and within the support space, the leaves being in close overlapping relation to effectively define a hollow cone about the beam of x-rays passing through the housing, the free ends of the hollow cone at the narrow portion of the cone defining an aperture, whereby the extent of relative movement between the first support means and the second support means determines the size and shape of the aperture such that the radiation beam will be intercepted and absorbed by the leaves except for that portion which enters the aperture.

22. A radiation collimator as recited in claim 21 further including means associated with the leaves to maintain them in close frictional relation at their areas of contact.

23. A radiation collimator as recited in claim 21 wherein the leaf support means is pivot means at each end of the leaves for pivotal support on and between the first support means and second support means, the leaves being moveable about their pivot means in close overlapping relation.

24. A radiation collimator as recited in claim 23 wherein the pivot means comprises a support rod secured to each leaf along the leaf's longitudinal axis, the support rod extending past the ends of the leaf, one end each for pivotal operation with the first support means and second support means, respectively.

25. A radiation collimator for collimating a beam of radiation, comprising;

a housing;

support means having thereon defined a support space, the support means mounted on the housing to intercept the beam of radiation and permitting passage of the beam of radiation therethrough; and a plurality of longitudinally extending leaves of radiation absorbing material having pivot means at each end of the leaves for pivotal support on the support means and within the support space, the leaves being moveable about their pivot means in close overlapping relation to define a hollow cone about the beam of radiation passing through the collimator.

26. A radiation collimator as recited in claim 25 wherein the pivot means comprises a support rod secured to the leaf and having extension means at each end of the leaf for pivotally operating with the support means.

27. A radiation collimator as recited in claim 25 wherein the pivot means comprises a support rod secured to the leaf and having extension means at each end of the leaf of pivotally operating with the support means.

28. A radiation collimator as recited in claim 27 further including first adjusting means operatively associated with the first support to permit aligning the passage through the first support with respect to the longitudinal axis of the beam of radiation passing through the passage.

29. A radiation collimator as recited in claim 28 further including second adjusting means operatively associated with the second support to permit aligning the passage through the second support with respect to the longitudinal axis of the beam of radiation.

30. A control for a collimator device for use with an x-ray apparatus, the collimator device including a hollow cone collimator positioned to intercept a beam of x-rays directed toward the collimator device, a pair of long shutters positioned to intercept the beam of radiation passing through the hollow cone collimator, a pair of cross shutters positioned to intercept the beam of radiation and located between the hollow cone collimator and the long shutters, and a housing having mounted therein the hollow cone collimator, the cross shutters and the long shutters, the housing permitting passage of the beam of radiation therethrough, the control comprising:

a first hollow shaft operatively associated at one end with the pair of long shutters and at its other end having means to releaseably fix the first hollow shaft at a preselected position on the exterior of the housing;

a second hollow shaft telescoped within the first hollow shaft and operatively associated at one end with the cross shutters and at its other end having means to releaseably fix the second hollow shaft at a preselected position on the exterior of the housing; and a third shaft telescoped within the second hollow shaft and operatively associated at the one end with the hollow cone collimator and at its other end having means to releaseably fix the third shaft at a preselected position on the exterior of the housing, whereby the first hollow shaft, second hollow shaft and third shaft can each be independently rotated to a selected position to locate the long shutters, cross shutters and hollow cone collimator, respectively, at desired settings to intercept the beam of radiation passing through the housing.

* * * * *